United States Patent [19]

Möltner

[11] Patent Number: 4,768,370

[45] Date of Patent: Sep. 6, 1988

[54] ROLLING LINE FOR THE STRETCH-REDUCING OF TUBES

[75] Inventor: Hermann Möltner, Grevenbroich, Fed. Rep. of Germany

[73] Assignee: Kocks Technik GmbH & Co., Hilden, Fed. Rep. of Germany

[21] Appl. No.: 849,014

[22] Filed: Apr. 7, 1986

[30] Foreign Application Priority Data

May 18, 1985 [DE] Fed. Rep. of Germany ..... 3517975

[51] Int. Cl.[4] ..... B21B 17/00; B21B 35/10

[52] U.S. Cl. ..... 72/234; 72/249; 74/665 M

[58] Field of Search ..... 72/235, 234, 226, 249; 74/665 L, 665 M, 665 P, 421 A

[56] References Cited

U.S. PATENT DOCUMENTS

| | | | |
|---|---|---|---|
| 3,992,915 | 11/1976 | Hermes et al. | 72/249 X |
| 4,000,637 | 1/1977 | Gerhards et al. | 72/226 |
| 4,020,667 | 5/1977 | Demny et al. | 72/234 X |
| 4,388,819 | 6/1983 | Moltner | 72/249 X |
| 4,430,875 | 2/1984 | Demny et al. | 72/249 X |

OTHER PUBLICATIONS

Brauer, Hans, "Developments-Rolling Mill Blocks in Modern Kocks Mills", *Iron and Steel Engineer*, Jan. 1978, pp. 55-67.

*Primary Examiner*—Robert L. Spruill
*Assistant Examiner*—Steven B. Katz
*Attorney, Agent, or Firm*—Buchanan Ingersoll

[57] ABSTRACT

A rolling line for the stretch-reducing of tubes, has a plurality of rolling stands which are arranged closely one after the other. These rolling stands are driven by a group drive, whereby the rolling stands, or at least a part thereof, are divided into groups, the groups being defined between directly acting drive shafts (111). The stand locations lying between these drive shafts (111) are driven by way of differential gear stages (112), each combining two rotational speeds which are derived by way of gear wheel trains (113-116, 117-120) from the drive shafts (111).

3 Claims, 5 Drawing Sheets

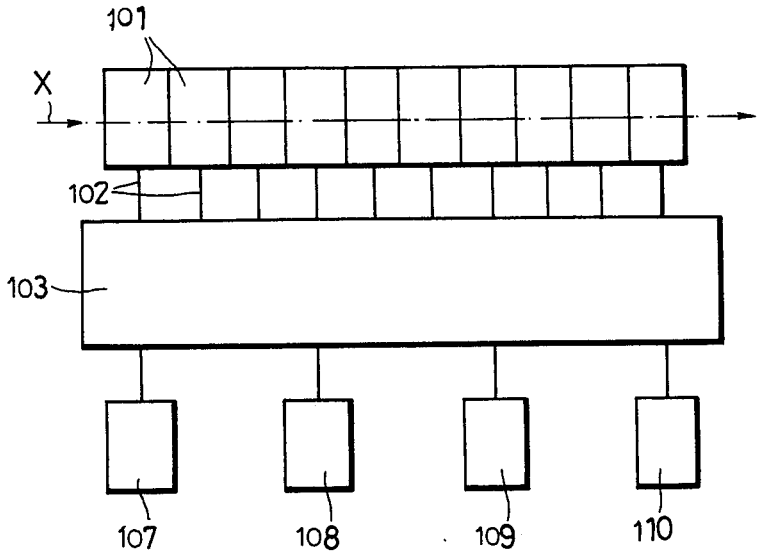
FIG.7
FIG.8
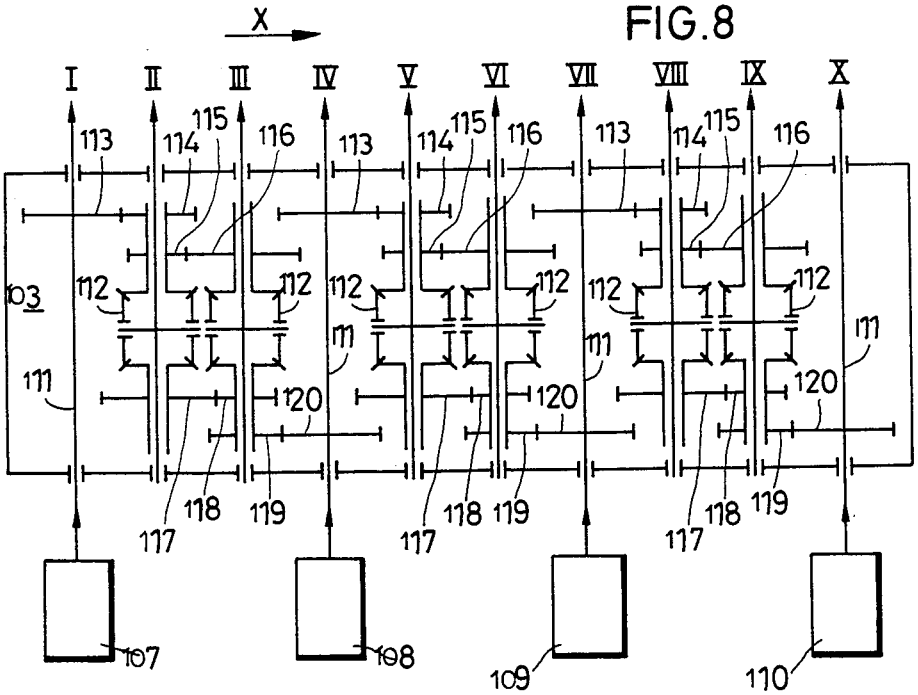

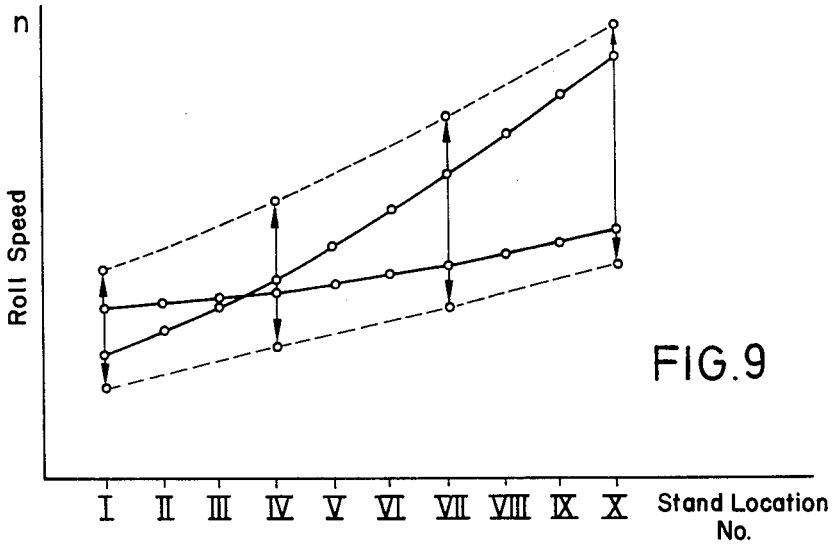
FIG.9
FIG.10
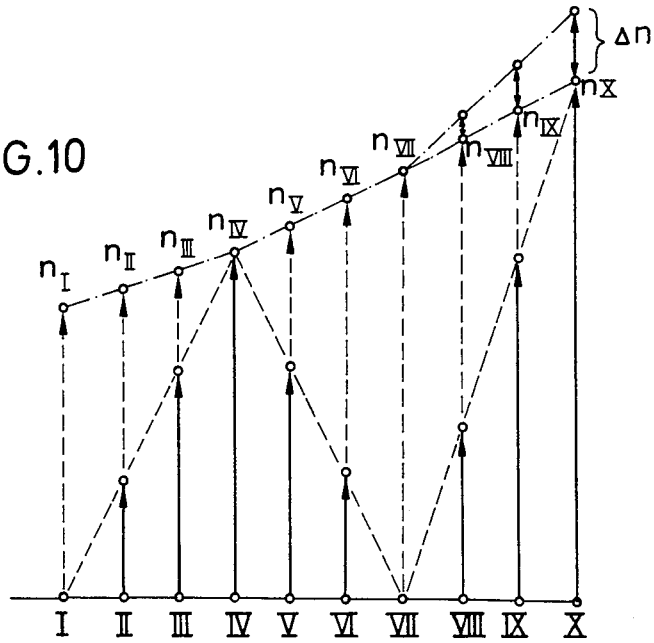

ROLLING LINE FOR THE STRETCH-REDUCING OF TUBES

DESCRIPTION

The invention relates to a rolling line for the stretch-reducing of tubes, having a plurality of rolling stands which are arranged closely one after the other and more particularly to a rolling line whose roll sets at some of the stand locations are directly driven by only one motor, each by way of a drive shaft, whilst those at other stand locations are driven by two independently controllable motors, each by way of a planetary gear stage combining the rotational speeds of the two motors, whereby those roll sets disposed between the roll sets driven directly by only one motor form a group which is driven by the motors of the roll sets at the entry end and at the delivery end of the group.

In a known rolling line of this type (German Offenlegungsschrift No. 18 05 661), the roll sets belonging to a group are driven from the two motors disposed at the entry end and at the delivery end, mostly by way of two or even more planetary gear stages which are connected one behind the other in the work flow. Thus, an extremely large number of planetary gear stages is required to drive all the roll sets of the rolling line, especially if one considers that this type of rolling line can have more than thirty rolling stands or roll sets.

Furthermore, in this known construction, almost the entire drive power, with the exception of only the small portion received by the roll sets directly driven by only one motor by way of a drive shaft, is distributed by way of the planetary gear stages, whereby individual planetary gear stages have to transmit the full power for, for example, seven roller sets. The known construction thus not only has a large number of planetary gear stages, but these planetary gear stages, in view of the power to be transmitted, often have to be extremely large and heavy. Consequently, the outlay on construction and manufacturing technology for the drive of this known rolling line is extremely high, a fact which obviously leads to uneconomically high investment costs. These high costs, together with the large amount of space required by this type of drive, particularly transvese to the rolling direction, have resulted in this know model never having been implemented in practice, so far as is known.

It has long been known, for example from German Patent Specification No. 10 54 408, to use planetary gear stages in rolling lines for the stretch-reducing of tubes. The roll sets, each driven by way of a planetary gear stage, produce an elongation of the work material, which elongation can be varied, for example by altering the rotational speed of the auxiliary motor. Such an adjustment of the elongation is effected commonly for all the roll sets driven by way of any one planetary gear stage, that is, the rotational speed transmission ratio in all the roll sets is altered uniformly by the same percentage.

Rolling lines of this kind have proved to be successful in practical operation and can be controlled and regulated very reliably. This is particularly important in the event of fluctuations of the wall thicknesses in the incoming tubes. Such fluctuations in wall thickness can be largely compensated for by a rolling line of this kind. It is even possible to compress the tubes axially instead of elongating them, in order to obtain finished tubes which have a thicker wall than the incoming tubes. If the changes in elongation required in the aforementioned cases extend over a relatively large length of from, for example, two to three metres of the tube to be rolled, a rolling line having the known drive can be adapted to this and can largely compensate for the fluctuations in wall thickness which have been established. However, difficulties arise if these differences in wall thickness extend over a shorter length of the tube, since the control path of the known rolling line, within which the elongation varies, is too large if the total elongation is varied by means of the adjusting device. Changes in elongation required and adjusted for certain short lengths of work material to compensate for fluctuations in wall thickness can, in the case of the control path of the rolling line being too long, affect adjacent lengths of work material for which they are not intended, thus causing new and undesirable deviations in wall thickness to occur.

In order to avoid these disadvantages, a rolling line has already been developed (U.K. Patent specification No. 2080169A) in which the rolling line is divided into two rolling stand groups, producing two shorter control paths by means of which it is also possible to compensate for differences in the wall thicknesses over shorter lengths of tube.

In the case of stretch-reducing rolling lines having a large number of roll sets arranged one after the other, it is quite possible that the control paths could still be too long even if they have been divided into two groups, as in U.K. Patent specification No. 2080169A. With the drive principle in the latter publication, it is not possible to divide the rolling line into yet more groups, because only two directions of rotation are available for each of the two auxiliary motors and, as a result, only rotational speeds can be added to or subtracted from the main rotational speed, which only allows the formation of two groups.

Although it is known, from German Offenlegungsschrift No. 22 29 320, to divide a rolling line into more than two groups, this division is so complete that it is no longer possible to regard it as being a uniform mechanically interconnected drive for all the roll sets in the rolling line. Three roll sets are jointly driven by one motor, which does not have any influence at all on the other roll sets. This known rolling line should, in view of the drive, be regarded as a series of several individual rolling lines arranged one after the other, each of which is driven by one motor only, wherein each motor must be controlled in the complex manner known from the individual drive system. Furthermore, this known construction has the considerable disadvantage that the elongation within each group is made invariable by the fixed gear wheel transmission ratios. As a result, this known drive type only allows the elongation to be altered in the region between the groups, which is completely inadequate.

It is an object of the invention to provide a rolling line which has a uniform group drive with which the rotational speed transmission ratio, and thus the elongation, can be changed among all the roll sets and which has short control paths to compensate for fluctuations in wall thickness even over a shorter length.

The invention resides in a rolling line for the stretch-reducing of tubes, having a plurality of rolling stands which are arranged closely one after the other and whose roll sets at some of the stand locations are directly driven by only one respective independently controllable motor each by way of a respective drive shaft, whilst those roll sets at other of the stand locations between two directly driven stands are driven by way of two gear trains from the drive shafts of such two directly driven stands and a single respective planetary gear stage combining the rotational speeds of the two motors, whereby those roll sets disposed between the directly driven roll sets form a group which is driven by the motors of the directly driven roll sets to the entry end and to the delivery end of the group.

Thus the rolling line can be subdivided into any number and size of groups of rolling stands as required, whereby the individual groups can have different numbers of rolling stands. Elongation is alterable within these groups, and, furthermore, the elongation in one or more of the groups can also be altered relative to the elongations in other groups. With this type of rolling line, short sectional lengths of tube can also be subjected to a predetermined tension in order to compensate for fluctuations in wall thickness on this relatively short section. To do this, it is not even necessary, in the rolling line according to the invention, to have a planetary gear stage for every roll set or stand location, as several roll sets are directly driven by only one motor by way of a drive shaft. The other roll sets are driven by only one planetary gear stage each, which needs only to transmit the power required by the roll set with which it is associated. As a result, the planetary gear stages can be of a relatively light construction, have small dimensions, and can therefore be accommodated in the smallest possible space. The reduced number of planetary gear stages and their light construction considerably reduce the space required and the manufacturing and investment costs, and allow a driven system which, despite its adaptability, has a relatively simple design and can be economically manufactured, and which, furthermore, has the advantages of the group drive system. For this purpose, it is important to divide the drive of all the roll sets into a plurality of groups by providing a plurality of directly driven drive shafts, whereby the other roll sets, disposed between the roll sets driven in this way, are driven from the shafts lying in front at the intake end and behind at the delivery end, by way of two gear wheel trains and one planetary gear wheel stage each.

In a preferred embodiment of the invention, the gear wheels of the gear trains are laid out to correspond to a rotational drive speed series increasing by a uniform amount from stand location to stand location in the rolling direction. Thus a rotational speed curve is obtained which corresponds to a section of the periphery of a polygon, and this rotational speed curve can be used to achieve various rotational speed curves by approximation. However, it is also possible to select the gear wheels of the gear trains in a different manner.

In a further embodiment of the invention, the drive should be constructed in the manner according to the invention at least in the front half of the rolling line on the entry side. Thus it is not absolutely necessary, although perfectly possible, to drive all the stand locations in the manner according to the invention. This drive can be combined with other types of drive enabling numerous variations which can be quite important in individual cases.

The invention is further described, by way of example, with reference to the accompanying drawings, in which:

FIG. 7 is a diagrammatic plan view of a rolling line according to the invention;

FIG. 8 is a gear diagram of the rolling line of FIG. 7;

FIGS. 9 and 10 are diagrams showing two rotational speeds for the rolling line of FIGS. 7 and 8;

Figure 1:
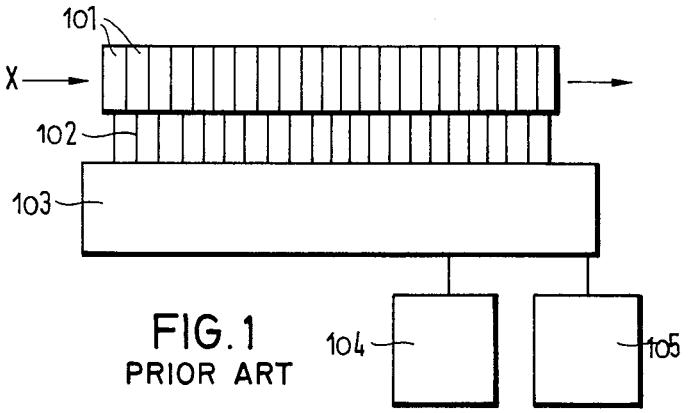
FIG. 1 PRIOR ART
FIG. 1 shows diagramatically a rolling line having a known group drive consisting of one group.

FIG. 1 shows rolling stands 101 disposed one after the other, whose roll sets are driven by a summing transmission 103 by way of drive shafts 102. The summing transmission 103 is driven by a main motor 104 and an auxiliary motor 105. The rolling direction in which the tubes to be reduced pass through the rolling stands 101 is shown by the arrow X.

Figure 2:
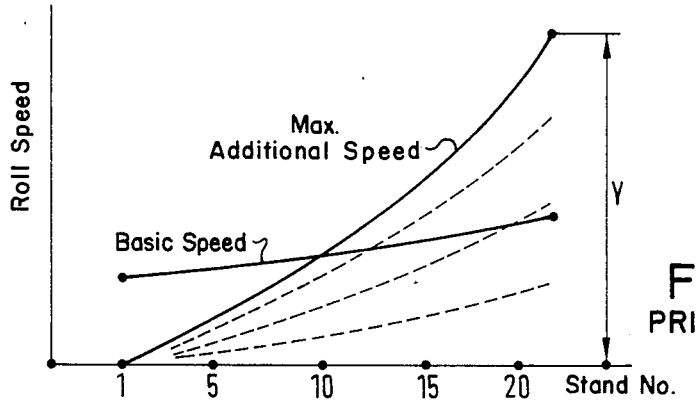
FIG. 2 PRIOR ART
FIGS. 2 and 3 are diagrams showing the individual roller speeds in the rolling line of FIG. 1.

In the graphical diagram of FIG. 2, the numbers identifying the individual rolling stands 1 are plotted along the abscissa, and the ordinate symbolises the rotational speeds of the rolls. The main rotational speed, produced by the main motor 104, increases slightly from rolling stand to rolling stand and it already has a predetermined minimum value for the first rolling stand 101 or stand 1. The rotational speed, produced by the auxiliary motor 105, is zero for stand 1, although it then increases to a greater extent from rolling stand 101 to rolling stand 101. The slope of the curve for the rotational speed can be increased or reduced by varying the drive speed of the auxiliary motor 105, this being symbolised by the arrow Y and by the diverging curves illustrated by broken lines. If the two rotational speeds for each rolling stand 101 are added together, which is effected in the summing transmission 103 by the planetary gear stages at the individual rolling stand locations, one obtains the graph of FIG. 3, wherein the value of the rolling speed corresponds to the value of the elongation, thus resulting in the fact that the elongation can be infinitely adjusted within a specific range.

Figure 4:
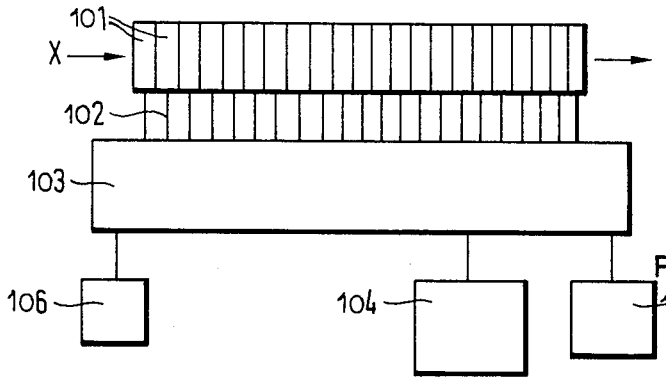
FIG. 4 PRIOR ART
FIG. 4 shows diagramatically a rolling line having a known group drive consisting of two groups.

In the same manner as in this known construction, the direction in which the work material passes from left to right through the second known rolling line of FIG. 4 is designated X and it is also provided with rolling stands 101, drive shafts 102, a summing transmission 103, a main motor 104 and an auxiliary motor 105. However, it is also provided with a second auxiliary motor 106, which, together with the main motor 104, only drives the, for example, first six rolling stands 101. The following, for example seventh, rolling stand 101 or stand 7, is driven directly and exclusively by the main motor 104, whereas the eighth rolling stand 101 or stand 8 and all the rolling stands 101 following towards the delivery end are driven from the main motor 104 and the auxiliary motor 105. In this manner, two groups of rolling stands are provided, namely the first group of rolling stands at the entry end and the second group of rolling stands at the delilvery end, a neutral rolling stand 101 being disposed between them which cannot be included in either of the groups of rolling stands as it is not driven by either of the auxiliary motors 105 and 106.

Figure 5:
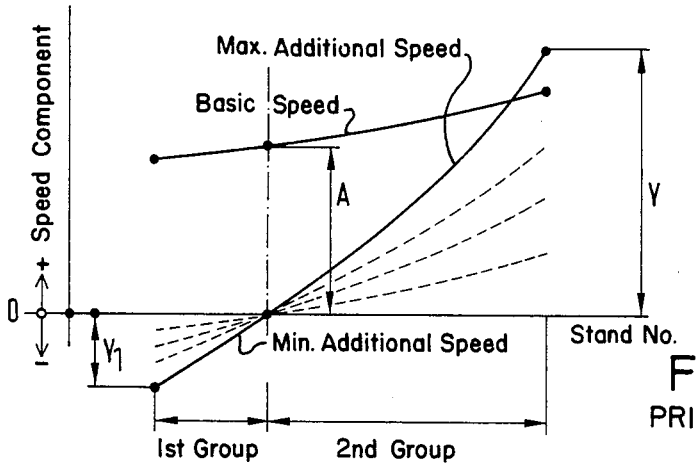
FIG. 5 PRIOR ART
FIGS. 5 and 6 are diagrams showing the roller speeds in the rolling line of FIG. 4.

FIG. 5 corresponds to FIG. 2 and, on the one hand, shows the characteristic of the basic rotational speeds and, on the other hand, shows the diverging array of the additional rotational speeds of the two auxiliary motors 105 and 106. Since the auziliary motor 106 of the first group of rolling stands 101 rotates in the opposite direction to the auxiliary motor 105 of the second group of rolling stands 101, a second diverging array of additional rotational speeds is produced which lies below a zero line extending through the rotational speed of the neutral, for example seventh, rolling stand 101. The reason for the latter is that this rolling stand 101 is only driven at the main rotational speed, and the additional rotational speed is thus always zero.

Alternatively, the series of additional rotational speeds for the two groups of rolling stands can be chosen such that a discontinuity exists in the speed curve in the region of the neutral, seventh, rolling stand 101. Greatly differing speed curves can be optionally chosen from the two rotational speed arrays of the first and second groups of rolling stands, this being symbolised by the arrows Y and $Y_1$, whereby the above-mentioned discontinuity can then be produced.

Figure 6:
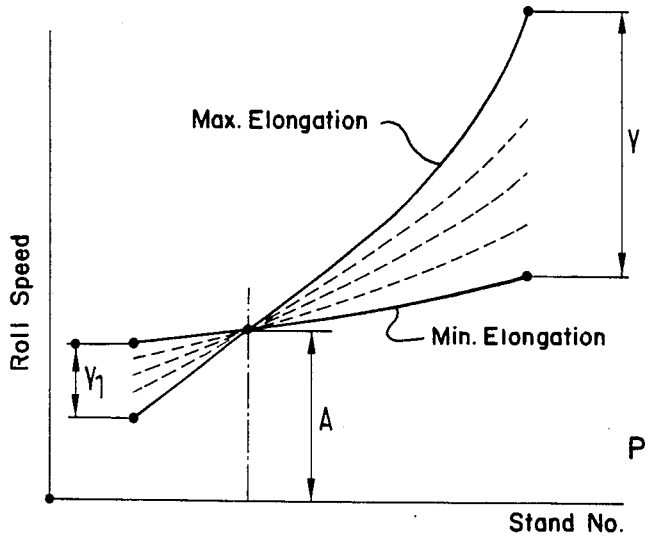
FIG. 6 PRIOR ART

The rotational speed curves illustrated separately in FIG. 5 are summed in FIG. 6, that is to say, the basic rotational speed and the associated additional rotational speed are added together in each case. Since the neutral rolling stand 101 disposed at the seventh stand location in the illustrated embodiment is driven only at the basic rotational speed, the rotational speed for this seventh rolling stand 101 is also at the same distance A from the abscissa in FIG. 6 as the basic rotational speed is from the zero line in FIG. 5. The curves have a somewhat steeper characteristic owing to the fact that the basic rotational speeds are added to the additional rotational speeds. In the present embodiment, the characteristic of the minimum rotational speeds or the minimum elongation in FIG. 6 corresponds to the characteristic of the basic rotational speed curve in FIG. 5, since the auxiliary motors 105 and 106 are then stationary.

FIG. 7 shows one embodiment of a rolling mill constructed according to the invention, in which, for the sake of simplicity, only ten rolling stands 101 are shown, although it is quite conceivable and practicable to have a considerably larger number of rolling stands. The roll sets of these rolling stands 101 are again driven by drive shafts 102 and a summing transmission 103, although, in this case, they are driven by a total of four motors 107 to 110. Again, a different number of motors could be chosen. The roll sets of the roll stands of the present invention are driven by drive means 107–120 as described below.

FIG. 8 shows the drive motors 107 to 110 in a gearing diagram of the summing transmission 103. The rolling stands 101 and their drive shafts 102 are represented in FIG. 8 by an arrow only, and the relevant stand locations are designated I to X. It can clearly be seen from this gearing diagram that the rolling stands 101 at stand locations I, IV, VII and X are driven directly by motors 107 to 110, each by way of a corresponding drive shaft 111 of which the relevant drive shaft 102 can be regarded as a combination. The rolling stands 101 or roll sets of the stand locations II and III form a group which is disposed between the roll sets at the stand locations I and IV whose roll sets are driven directly by only one motor 107 or 108. This type of group is therefore defined at the entry end and at the delivery end by the drive shafts 111 which ae driven directly by the motors, in this case the motors 107 and 108. In the same way, the roll sets at stand locations V and VI and those at stand locations VIII and IX each form a further group. All the roll sets belonging to one of these groups are driven by only one planetary gear stage 112 in each case, which planetary gear stage adds together two rotational speeds in each case. These two rotational speeds are derived and transmitted from the drive shafts 111 defining the groups by way of gear trains 113 to 116 and 117 to 120 extending parallel to the rolling direction X. The gear trains 113 to 116 of each group transmit the rotational speeds from the drive shaft 111 defining the entry end to the planetary gear stages 112 of the relative group, and the gear trains 117 to 120 of each group transmit the rotational speeds of the drive shafts 111 defining the delivery end to the planetary gear stages 112 of the relevant group. The gear trains 113 to 120 have a transmission ratio which deviates from 1:1, as can clearly be seen in FIG. 8.

In the graph in FIG. 9, the abscissa shows the numbers of the stand locations and the ordinate shows the rotational speeds of the rolls. The two curves shown by the thick unbroken lines are two examples of the many rotational speed curves possible. The points on these rotational speed curves represent the drive speeds for the individual stand locations I to X, as developed by the gear trains 113 to 120 and the planetary gear stages 112. This does not apply to stand locations I, IV, VII and X, as they are driven from a motor, and not by planetary gear stages. As all the motors 107 to 110 can be controlled independently of one another, it is possible to change as required, within a wide range, not only the gradients of the curves shown, but also the distance from the abscissa, so that it is possible to produce very different almost arbitrary, rotational speed series, whereby the extension can again be altered within a wide range, and also along the length of the rolling line, although locally defined.

The graph in FIG. 10 shows the rotational speed contributed by the individual motors 107 to 110 at the individual stand locations I to X to the final drive speed n. At stand location I, the drive speed $n_I$ is achieved exclusively by the motor 107, whereas the final drive speed $n_{II}$ of stand location II is achieved by the motor 107, which component is shown by a dotted line, and by motor 108, shown by an unbroken line. It can clearly be seen that, as the number of the stand location becomes larger, the influence of the motor 107 decreases in favour of the motor 108, whose influence then decreases in favour of the motor 109, and so on. The rotational speed components of the motor 107 and, beyond stand location IV, of the motor 109 are shown by dotted lines, whereas the rotational speed components of the motor 108 up to stand location VI and of the motor 110 from stand location VIII onwards are represented by arrows with continuous lines.

In the embodiment shown in FIG. 10, the transmission ratios of the gear wheel trains 113 to 120 have been selected such that the dash-dotted line through the final rotational drive speeds $n_I$ to $n_X$ is, in sections, a straight line, with kinks in the region of stand locations IV and VII, that is, of motors 108 and 109, resulting altogether in the peripheral section of a polygon. The gradient of such a straight-lined section can be altered in a simple manner, as shown in FIG. 10 by the example in the case of motor 110. For example, the rotational speed of the motor 110 is to be increased by $\Delta n$ without altering the rotational speeds of the other motors. It can clearly be seen that, at stand locations VII, IX and X, the component of motor 110 increases, and the final rotational drive speeds become higher, which leads to a steeper, dash-dotted curve. Using this change in gradient, which is also possible in the region of the other curve sections by altering the rotational speeds of the other motors accordingly, almost any rotational speed curve can be obtained by approximation.

Figure 3:
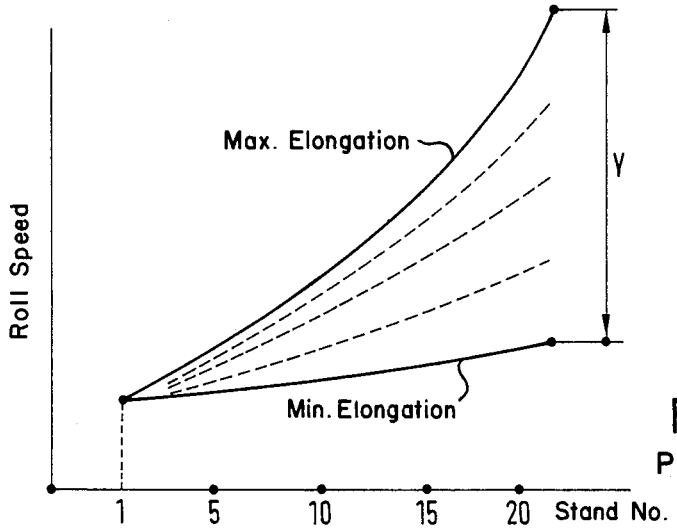
FIG. 3 PRIOR ART
Figure 11:
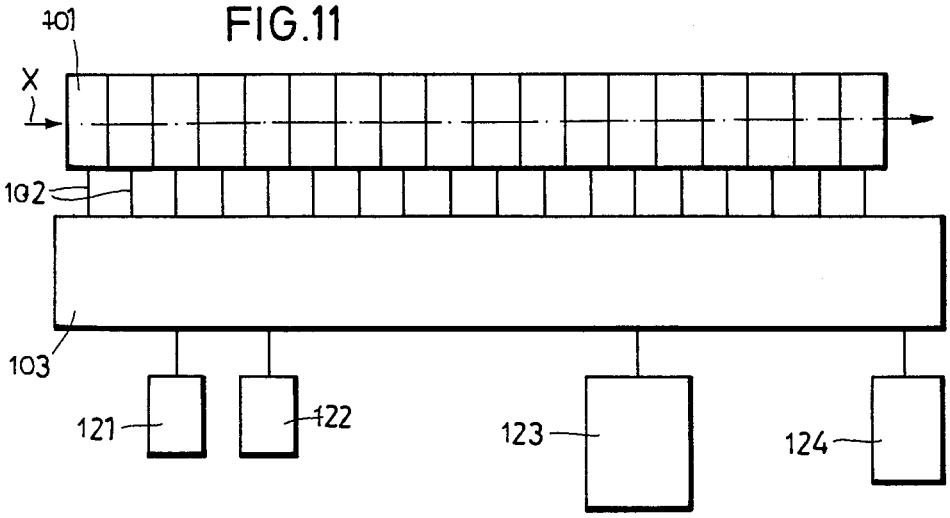
FIG. 11 shows diagramatically a rolling line having a drive part constructed according to the invention in combination with known drive parts.
Figure 12:
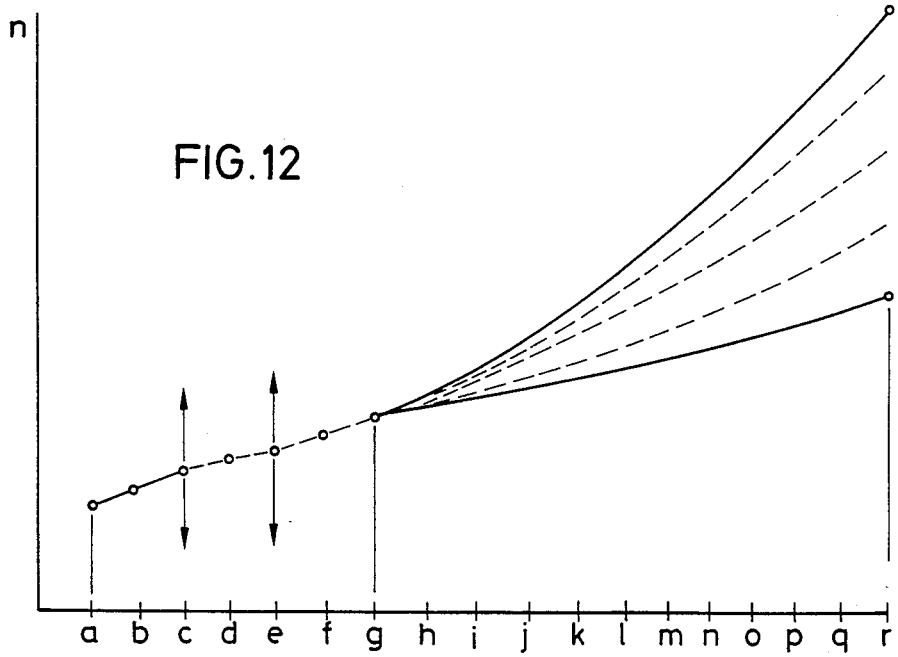
FIG. 12 is a diagram showing the roller speeds for the embodiment of FIG. 11.

FIGS. 11 and 12 show a rolling line in which only a part of the drive is constructed according to the invention. This applies to stand locations c to g. Stand locations a and b are driven from a drive motor 121 by way of a fixed rotational speed series without a planetary gear stage. Furthermore, motor 121 drives the roller set at stand location c directly, in the same way as motor 107 of FIG. 8. The same applies to a motor 122 and stand location e. Stand location d is driven as, for example, stand location II in FIG. 8, that is jointly by motors 121 and 122. Stand location f is driven by motors 122 and 123. Motor 123 contributes towards the rotational drive speed at stand location f, as does motor 109 to stand location V of FIG. 8. In contrast, stand locations g to r are driven as shown in FIG. 3, whereby motor 123 functions as the main motor and motor 124 functions as the auxiliary motor corresponding to motors 104 and 105 in FIG. 1.

What is claimed is:

1. A rolling line for stretchreducing of tubes, said rolling line having a plurality of rolling stands which are arranged closely one after the other, said rolling stands having roll sets, drive means connected to said roll sets to drive said roll sets, said drive means for some of said roll sets comprising one independently controlled motor only for each such roll set directly connected to each such roll set by respective drive shafts, said drive means for other of said roll sets located between two of said directly connected roll sets comprising two gear trains from the drive shafts of such two directly driven stands and a single respective planetary gear stage combining the rotational speeds of the two motors of said two directly controlled roll sets, whereby said two motors drive a group of roll sets formed by said other roll sets disposed between the directly connected roll sets.

2. A rolling line as claimed in claim 1, wherein the roll sets of said group have rotational speeds between the rotational speeds of said two motors and which speeds increase incrementally from stand location to stand location from an entry end of the group to a delivery end of the group.

3. A rolling line for the stretch reducing of tubes as claimed in claim 1, wherein said drive means drives each drive set at a different speed.

* * * * *

UNITED STATES PATENT AND TRADEMARK OFFICE

CERTIFICATE OF CORRECTION

PATENT NO. : 4,768,370

DATED : September 6, 1988

INVENTOR(S) : HERMANN MOLTNER

It is certified that error appears in the above-identified patent and that said Letters Patent is hereby corrected as shown below:

Column 1, line 45, change "know" to --known--.

Column 3, line 35, change "driven" to --drive--.

Column 5, line 5, change "auziliary" to --auxiliary--.

Column 5, line 68, change "ae" to --are--.

Column 8, line 1, Claim 1, change "stretchreducing" to --stretch-reducing--.

Signed and Sealed this

Sixth Day of June, 1989

*Attest:*

*Attesting Officer*

DONALD J. QUIGG

*Commissioner of Patents and Trademarks*